US005649822A

United States Patent [19]

Gertler et al.

[11] Patent Number: 5,649,822

[45] Date of Patent: Jul. 22, 1997

[54] GAS BURNER

[75] Inventors: Kurt Gertler; Werner Gronnenberg, both of Hagen; Klaus Holm, Herdecke; Jörn Naumann, Hagen, all of Germany

[73] Assignee: Elektro-und Gas-Armaturen-Fabrik GmbH, Hagen, Germany

[21] Appl. No.: 129,156

[22] PCT Filed: Sep. 17, 1992

[86] PCT No.: PCT/EP92/02144

§ 371 Date: Oct. 6, 1993

§ 102(e) Date: Oct. 6, 1993

[87] PCT Pub. No.: WO93/16328

PCT Pub. Date: Aug. 19, 1993

[30] Foreign Application Priority Data

Feb. 8, 1992 [DE] Germany ..... 42 03 668.2

[51] Int. Cl.[6] ..... F23D 14/62

[52] U.S. Cl. ..... 431/354; 126/39 E; 239/553.5

[58] Field of Search ..... 431/266, 354, 431/349, 350; 126/39 R, 39 E; 239/553.5

[56] References Cited

U.S. PATENT DOCUMENTS

| | | | |
|---|---|---|---|
| 873,182 | 12/1907 | Springer et al. | 239/553.5 |
| 3,211,208 | 10/1965 | Borwick | 239/553.5 X |
| 3,817,689 | 6/1974 | Capy | 431/349 |
| 3,874,841 | 4/1975 | Feclin | 126/39 E X |
| 3,905,756 | 9/1975 | Ferlin et al. | 431/354 |
| 4,168,950 | 9/1979 | Seemann et al. | 431/348 |
| 4,886,043 | 12/1989 | Homer | 126/39 E X |

FOREIGN PATENT DOCUMENTS

| | | | |
|---|---|---|---|
| 0902029 | 7/1985 | Belgium . | |
| 1234279 | 10/1960 | France | 431/349 |
| 1303237 | 7/1962 | France . | |
| 80694 | 4/1963 | France | 431/349 |
| 1360192 | 3/1964 | France . | |
| 1527971 | 6/1968 | France . | |
| 576000 | 4/1933 | Germany | 431/349 |
| 3709445 | 2/1991 | Germany . | |
| 0030521 | 3/1981 | Japan | 431/349 |
| 0049734 | 3/1982 | Japan | 126/39 R |
| 0036302 | 8/1929 | Netherlands . | |
| 0673817 | 4/1980 | U.S.S.R. | 431/326 |
| 299057 | 10/1928 | United Kingdom | 239/553.5 |
| 1579322 | 11/1980 | United Kingdom | 431/354 |
| 2240168 | 7/1991 | United Kingdom | 431/354 |

*Primary Examiner*—Carl D. Price
*Attorney, Agent, or Firm*—Anderson, Kill Olick P.C.

[57] ABSTRACT

An atmospheric gas burner includes a burner ring having a plurality of gas outlet ducts defining a respective plurality of gas outlet openings and each having a center axis extending at an angle greater than 0° relative to a radius of the respective outlet opening, and a burner cover overlying the burner ring with the burner ring having a portion projecting beyond outer edges of lower regions of the gas outlet openings, and the burner cover having a portion which overhangs about the outer edges of upper regions of the gas outlet openings.

1 Claim, 4 Drawing Sheets

GAS BURNER

BACKGROUND OF THE INVENTION

1. Field of the Invention

The invention is directed to a gas burner, particularly an atmospheric gas burner with premixing of primary air, with a burner ring having gas outlet ducts, and with a burner cover which may be constructed so as to form one piece with the latter.

2. Description of the Prior Art

Various constructions of gas burners for hearths are known. The known burners have flame outlet openings which are formed as slots, grooves or bore holes which are generally directed outwardly in a radial direction proceeding from an imaginary center point of the burner.

In the course of attempts to improve the efficiency of such burners and in particular also their environmental acceptability, i.e. to reduce emissions of noxious substances, burner constructions have been developed which diverge from the conventional types. Such burner designs are shown, for example, in DE-37 09 445-A1.

The object of the invention is to provide a solution by which, in particular, the $NO_x$ content as well as the CO content in the exhaust gas in atmospheric burners is significantly reduced, specifically over a large regulating range between low and high settings of the burner.

SUMMARY OF THE INVENTION

This object is met, according to the invention, in that the center axis of the gas outlet ducts lies at an angle diverging from 0° relative to a radius associated with the respective outlet opening.

The oblique position of the gas outlet ducts relative to an imaginary associated radius results in a significant whirling effect. After exiting the outlet ducts designed according to the invention, the gas/air mixture is whirled in a helical or spiraling manner resulting in optimal burn-up. The CO and $NO_x$ are accordingly reduced.

An additional advantage consists in that the flames cannot proceed along the shortest path from the flame outlet opening to the edge of the pot when the latter is put in place, but rather are compelled to remain for a longer period of time beneath the base of the pot, resulting in a kind of spiral stream beneath the pot base. Consequently, the flame energy can be exploited in a distinctly improved manner, i.e. in order to achieve uniform cooking output, the burner can either operate for a shorter period of time on the whole or can be operated at a lower setting so that the amount of noxious substances loading the environment is necessarily reduced in its entirety.

Further advisable constructions of the invention follow from the subclaims.

It is advisable, for example, that the gas outlet angle relative to the associated radii be adjusted between 15° and 90°, where a 90-degree angle results in a practically tangential outflow. The slots can be constructed as bore holes and can be straight or curved in their axial direction as well as in their cross-sectional shape. V-shaped cross sections can be provided as well as ducts of different dimensions which are arranged parallel next to one another, which leads to an optimal regulation between partial and full load. Additional outlet openings can also be provided for forming auxiliary flames in a manner known per se.

To facilitate adaptation of the flow conditions within the burner to specific applications, it may be advantageous to provide the burner cover with a flow guiding cone and/or with whirling/cooling ribs.

It has been shown that special adaptation between the outer contour of the burner cover and the outer contour of the burner ring relative to the outlet edges of the gas outlets also results in different burning behavior, for which the invention provides special designs, depending on the intended use, as indicated in the subclaims.

The flow ducts in the interior of the burner can also be designed in different ways according to the invention, either with or without flow cones.

Finally, it may be advantageous to provide for additional outlet openings in the adaptor mount through which secondary air can be sucked in from the trough space below the burner for flame cooling, as is likewise provided in a further construction of the invention. This step in which the flames are cooled also serves to maximize the use of fuel while reducing harmful emissions.

In the following, the invention is explained in more detail by way of example with reference to the drawing.

DETAILED DESCRIPTION OF THE PREFERRED EMBODIMENTS

Figure 1A:
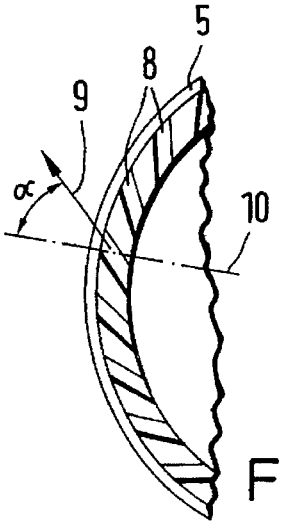
FIG. 1 shows a side view in partial section through a burner according to the invention with a partial top view of a construction of the gas outlet ducts in FIG. 1*a;*

The gas burner shown in partial section in FIGS. 1, 1*a* and designated in general by 1 is constructed as follows: a burner support 2 with an injector 20 penetrates a gas trough 3 from below, the latter being implied in the drawing. An adaptor mount 4 on which a burner ring 5 is supported encloses the region of the burner support projecting out over the gas trough 3. The burner ring 5 is shown in a partial view from the top in FIG. 1. The burner is closed at the top by a burner cover 6 which is outfitted in the center with an inwardly directed flow cone 7 in the example shown in FIG. 1.

It can be seen that the burner ring 5 is outfitted with a plurality of gas outlet ducts 8 whose center axis, indicated in FIG. 1*a* by an arrow 9, is arranged at an angle to the corresponding radius, designated by 10, which angle diverges from 0° and is designated by α in FIG. 1*a*. The free outlet end of the gas outlet ducts 8 is designated by 8*a*.

Figure 6:
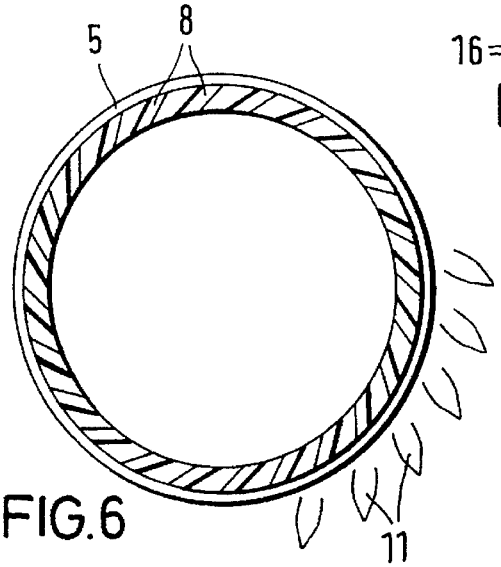
FIG. 6 shows a top view of a burner ring, according to the invention, with straight gas outlet ducts and flames shown in an implied manner.
Figure 7:
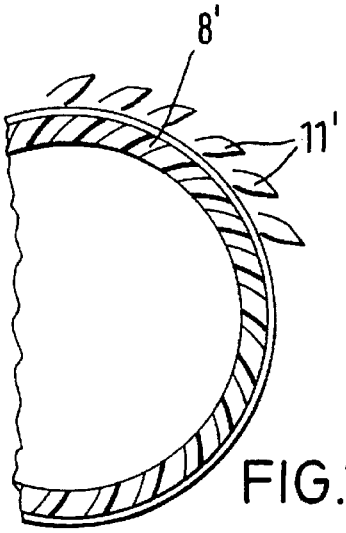
FIG. 7 shows a partial view of a modified example of a burner ring with curved gas outlet ducts.

Similarly to FIG. 1*a*, FIG. 6 shows a top view of the burner ring 5 with implied flames 11 which, as can be seen, are not directed radially outward, but rather form an angle to the radial flow so as to result in a whirling formation. The ducts 8 shown in FIGS. 6 and 1*a* are constructed in a straight line as seen from the top. FIG. 7 shows a possibility for a curved design of these ducts. The ducts shown in FIG. 7 are designated by 8' and the formed flames by 11'.

Figure 9:
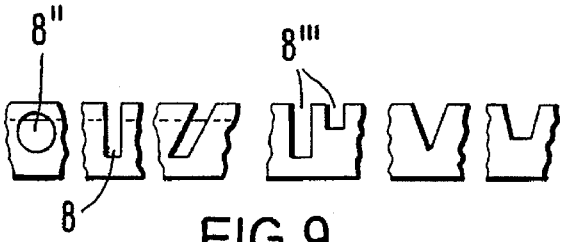
FIG. 9 shows cross-sectional designs of gas outlet ducts.

Just as the ducts 8 and 8' can be constructed so as to be straight or curved as seen from the top, they can also have different cross-sectional shapes. A selection of these cross-sectional shapes is indicated in FIG. 9. In addition to ducts having U-shaped, V-shaped or I-shaped cross sections, ducts with a circular cross section can also be provided as indicated in FIG. 9 by 8" or adjacent ducts may have different cross-sectional dimensions as indicated in FIG. 9 by 8".

Figure 2:
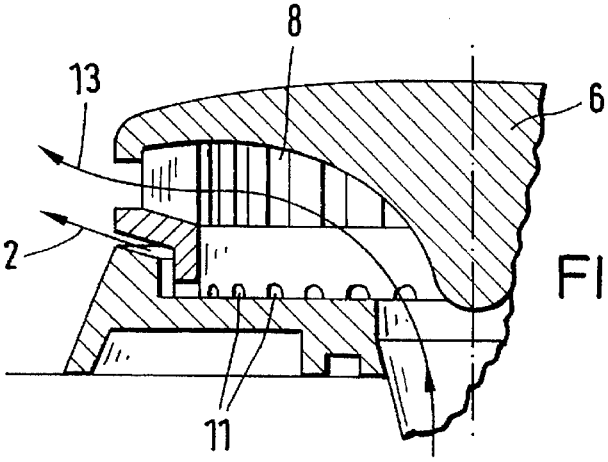
FIGS. 2 to 4 show sections through variants of burners according to the invention.

As is known, per se, additional gas outlet slots or bore holes, designated by 11 in FIG. 2, can be provided below the gas outlet ducts so as to form auxiliary flames at full load, for example, as indicated in FIG. 2 by an arrow 12. The configuration of the gas flow through the gas outlet ducts 8 is designated by 13.

Figure 3:
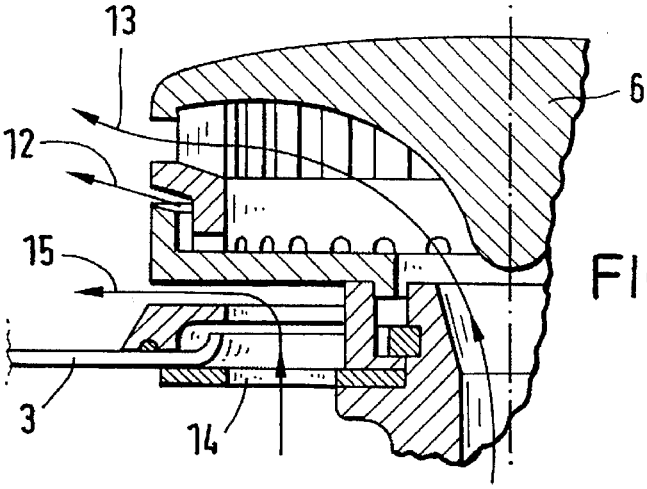
Figure 4:
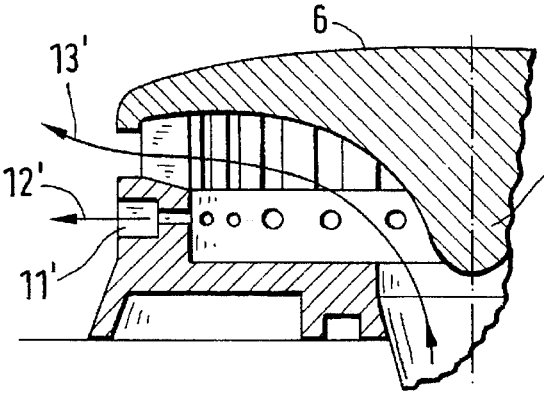

In addition, FIG. 3 shows that additional openings 14 can be provided to suck in secondary air from below the trough 3. This secondary air, whose flow path is designated by 15 in FIG. 3, serves to cool the flames.

As far as possible, structural component parts having the same function are designated by identical reference numbers in the various drawings. For example, the burner cover is consistently designated by 6, even though its cross-sectional shape or the construction of its edge may vary from one view to another.

Figure 5A:
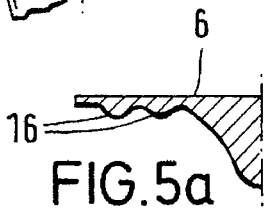
FIGS. 5*a* and 5*b* show partial sections through burner cover constructions.
Figure 5B:
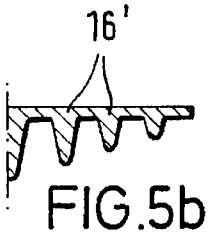
Figure 8A:
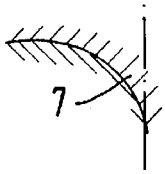
FIGS. 8*a* and 8*b* show constructions of the flow cone.
Figure 8B:
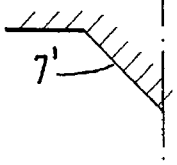

The flow cone 7, which also has the same reference number in all of the Figures, can have a curved or straight shape with respect to its cross section, as shown in FIGS. 8 and 8*b*, respectively. For the sake of simplicity, the curved flow cone is designated by 7 (FIG. 8*a*) and the straight flow cone in the example of FIG. 8*b* is designated by 7'. In addition to the flow cone, cooling ribs 16 may also be provided, e.g. in the cover 6. These cooling ribs 16 may have a helical or spiral shape for creating a pre-whirling or can also enclose the flow cone concentrically. Different cross-sectional shapes are shown in FIGS. 5*a* and 5*b*.

Figure 10:
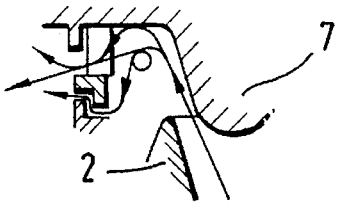
FIG. 10 shows a partial section in the region of the flow cone.

Flow configurations at various load ranges are indicated by arrows in FIG. 10.

FIGS. 11 to 15 show different designs of the configuration of the gas outlet ducts 8 relative to the free front edge 6*a* of the burner cover and the free front edge 5*a* of the burner ring, respectively, relative to the outlet opening 8*a*.

Figure 11:
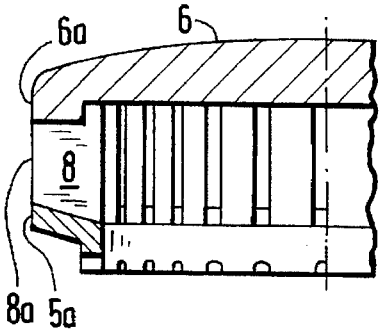
FIGS. 11 to 15 show different edge constructions of burner covers and burner rings in the region of the gas outlet openings.

FIG. 11 shows a design in which these three elements, i.e. the free outer edge 6*a* of the burner cover 6, the outlet opening 8*a* of the flow ducts 8, and the outer edge 5*a* of the burner ring 5, are exactly flush with one another.

Figure 12:
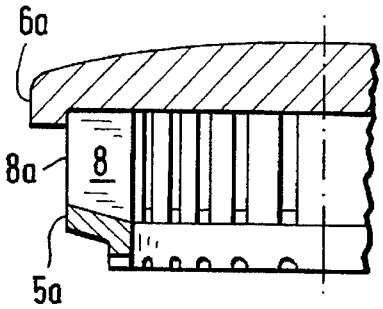
Figure 13:
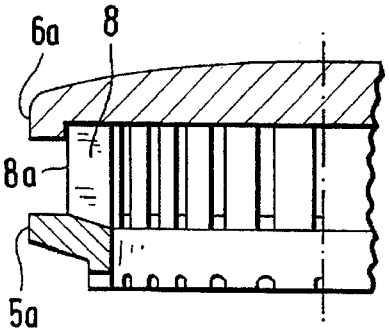
Figure 14:
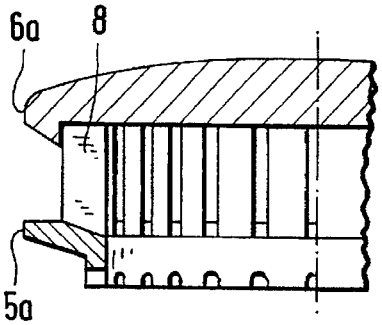
Figure 15:
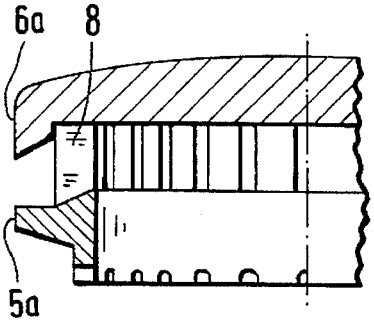

FIG. 12 shows a design in which the free outer edge 6*a* of the burner cover 6 projects over both the gas outlet opening 8*a* and the free outer edge 5*a* of the burner ring 5. In FIG. 13, the free edges 6*a* and 5*a* project over the gas outlet openings 8*a*. FIG. 14 shows a design similar to that in FIG. 13, but in which the transitional areas passing into the free outer edges 6*a* and 5*a* are different. FIG. 15 shows a converging configuration.

All of the constructions of the gas outlet ducts 8 and the geometrical configurations of the gas outlet openings 8*a* result in different burning behavior and accordingly in different emissions of noxious substances. The type of gas, gas pressure, ambient temperature and the like are also included as parameters. Correspondingly different geometrical designs are provided depending on the type of gas.

Figure 16:
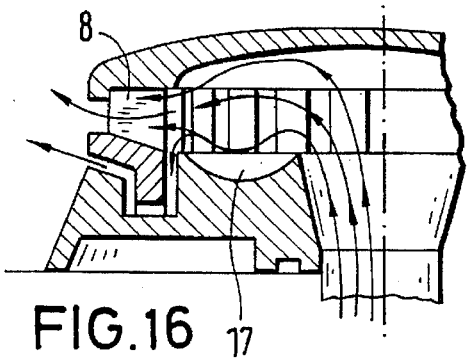
FIGS. 16 to 19 show different partial cross sections through burners with different gas flow control in the interior of the burner with auxiliary flame formation with full burning.
Figure 17:
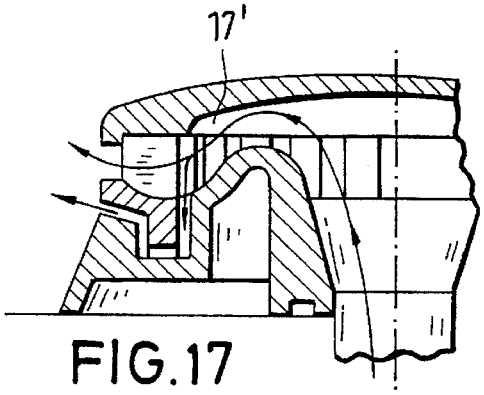
Figure 18:
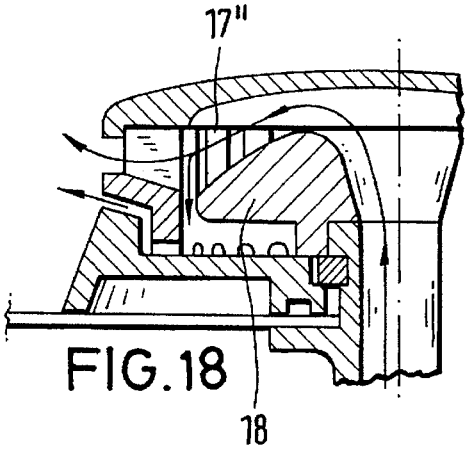
Figure 19:
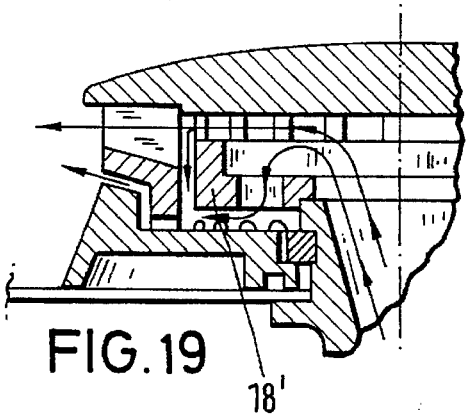

Variations of the inner gas flow paths are shown in FIGS. 16 to 19. FIG. 16 shows a flow space for the gas which bulges out prior to entering the gas outlet ducts 8 and is designated by 17. FIG. 17 shows a substantially parallel guidance of the gas flow path 17'. FIG. 18 shows a region 17" which widens from the inside toward the outside as a result of a gas guiding or deflecting body 18 in the interior of the burner. Finally, FIG. 19 shows another baffle insert 18' which optimizes the secondary flame formation in particular.

Figure 1:
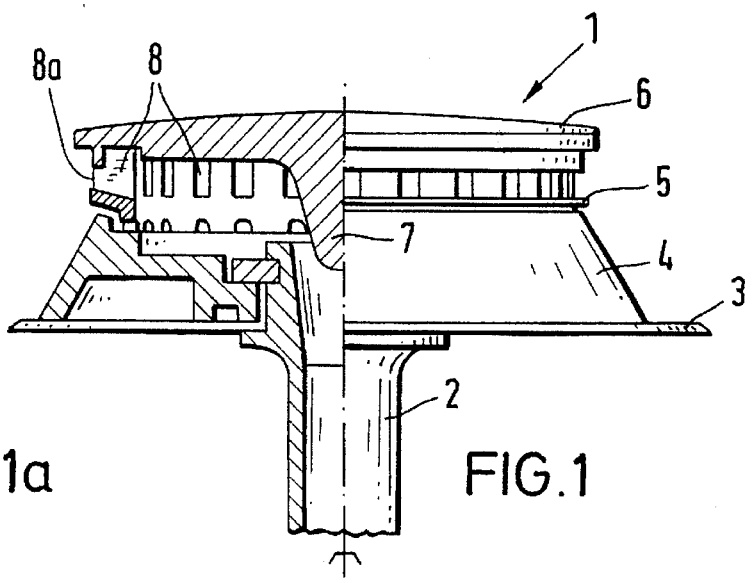
Figure 20:
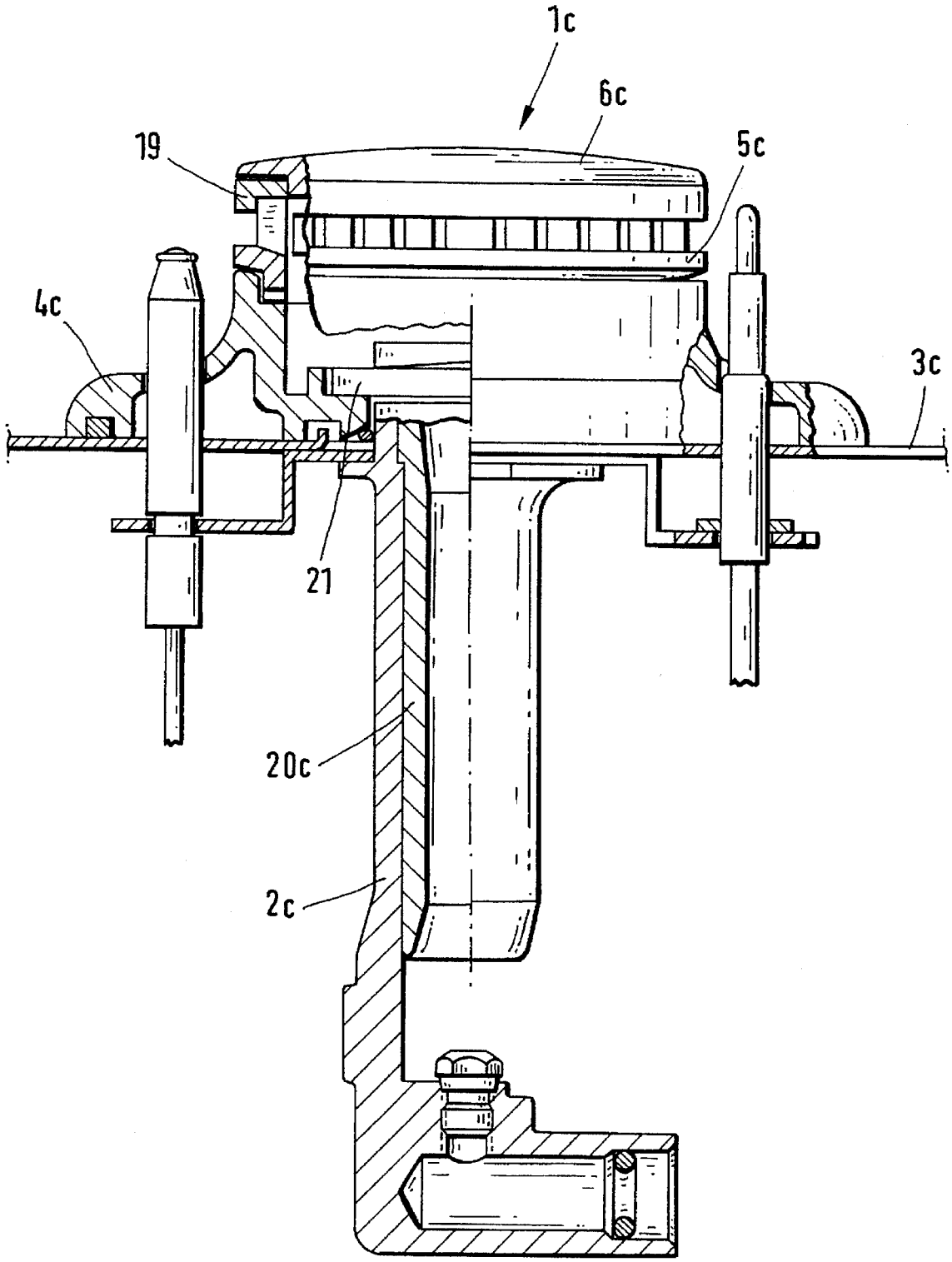
FIG. 20 shows a side view in partial section through another embodiment example of a burner.

FIG. 20 shows another embodiment example of the invention in which parts which are otherwise identical to those in FIG. 1 have the same reference numbers with an added "c". The injector 20*c* is fastened at the support 2*c* by means of a clamping ring 21. The adapter mount 4*c* can also be fixed at the plate of the cooking trough 3*c* by the clamping ring 21 simultaneously.

In contrast to the preceding examples, the burner in this example is constructed in three parts from the burner ring elements 5*c* and the burner cover elements 6*c*, since an intermediate disk 19 which also provides the flow edge for the gas flame is provided in the front edge region of the burner cover 6*c*.

Naturally, the described embodiment examples of the invention can be further modified in many respects without departing from the fundamental idea. Thus, the cross-sectional shapes of the baffle body and guiding body mentioned above represent examples, as do the designs of e.g. the flow guiding cone 7, the cooling ribs 16 or the special cross-sectional shapes and configurations of the ducts 8.

We claim:

1. An atmospheric gas burner with premixing of primary air, comprising:

a burner ring having a plurality of gas outlet ducts defining a respective plurality of gas outlet openings having outer upper and lower edges, said outlet ducts each having a center axis extending at an angle greater than 0° relative to a radius associated with a respective opening, and said burner ring having a portion projecting beyond the outer lower edges of said gas outlet openings;

a burner cover overlying said burner ring and having a portion which overhangs the outer upper edges of said gas outlet openings;

a burner support, said burner cover having at least one flow cone extending toward said burner support; and whirling and cooling ribs arranged concentrically around said flow cone.

* * * * *